US011260409B2

(12) United States Patent
Ribeiro et al.

(10) Patent No.: US 11,260,409 B2
(45) Date of Patent: Mar. 1, 2022

(54) ARRANGEMENT FOR DUAL LIQUID COMPONENT PACKAGING

(71) Applicant: TERPENOIL TECNOLOGIA ORGANICA LTDA, Jundiai (BR)

(72) Inventors: Marcelo Ebert Ribeiro, Sao Paulo (BR); Rodrigo Dangelo, Curitiba (BR)

(73) Assignee: TERPENOIL TECNOLOGIA ORGANICA LTDA, Jundiai (BR)

( * ) Notice: Subject to any disclaimer, the term of this patent is extended or adjusted under 35 U.S.C. 154(b) by 426 days.

(21) Appl. No.: 16/346,228

(22) PCT Filed: Nov. 23, 2018

(86) PCT No.: PCT/BR2018/000070
§ 371 (c)(1),
(2) Date: Apr. 30, 2019

(87) PCT Pub. No.: WO2019/109154
PCT Pub. Date: Jun. 13, 2019

(65) Prior Publication Data

US 2021/0331189 A1 Oct. 28, 2021

(30) Foreign Application Priority Data

Dec. 4, 2017 (BR) ..... 202017026095-5

(51) Int. Cl.
*B05B 11/00* (2006.01)
*B65D 81/32* (2006.01)

(52) U.S. Cl.
CPC ..... *B05B 11/0008* (2013.01); *B05B 11/0081* (2013.01); *B65D 81/32* (2013.01)

(58) Field of Classification Search
CPC ..... B05B 11/0008; B05B 11/0078; B05B 11/0081; B05B 11/0083; B05B 11/3081;
(Continued)

(56) References Cited

U.S. PATENT DOCUMENTS 5,421,483 A * 6/1995 Parise ..... B05B 11/0078 222/82
9,987,645 B2 * 6/2018 Richman ..... B05B 11/0054
(Continued)

FOREIGN PATENT DOCUMENTS

EP 1 693 311 A1 8/2006
WO 2005/090189 A1 9/2005

OTHER PUBLICATIONS

Written Opinion for PCT/BR2018/000070, dated Feb. 12, 2019.
International Search Report for PCT/BR2018/000070, dated Feb. 12, 2019.

*Primary Examiner* — Lien M Ngo
(74) *Attorney, Agent, or Firm* — Sughrue Mion, PLLC

(57) ABSTRACT

The present patent application relates to an arrangement for a packaging of a dual liquid component, which comprises a first component and a second component, the arrangement for the packaging that includes a container and an auxiliary device for application of the dual liquid component product. The container may have an upper, tubular part having a frustum-shape, and a lower part. The upper, tubular part may comprise an upper neck, in which the auxiliary device for application of the dual component product is assembled, and an upper wall with an open base, the upper wall being fitted with internal stops located internally near the neck and a seat located internally near the open base. The open base may host a sealing ring with an internal thread. The lower part may store the second component and may comprises a bottom, a lower wall, an upper free end fitted with an external thread and an adjacent seat strip located under the external thread.

15 Claims, 5 Drawing Sheets

(58) Field of Classification Search
CPC . B65D 81/32; B65D 81/3227; B65D 81/3244
USPC ..... 222/153.01, 145.5, 145.6, 321.1, 222/321.7–321.9, 83, 83.5, 87, 88, 129, 222/383.1, 136; 206/219, 222
See application file for complete search history.

(56) References Cited

U.S. PATENT DOCUMENTS

| | | | | |
|---|---|---|---|---|
| 2008/0302803 | A1* | 12/2008 | Yacko | B05B 11/0081 220/523 |
| 2009/0159614 | A1* | 6/2009 | Yacko | B65D 23/12 222/129 |
| 2014/0361016 | A1 | 12/2014 | Moreau | |
| 2016/0052006 | A1* | 2/2016 | Pirtle | B05B 11/0008 239/302 |

* cited by examiner

ARRANGEMENT FOR DUAL LIQUID COMPONENT PACKAGING

CROSS REFERENCE TO RELATED APPLICATIONS

This application is a National Stage of International Application No. PCT/BR2018/000070 filed Nov. 23, 2018, claiming priority based on Brazilian Patent Application No. 202017026095-5 filed Dec. 4, 2017, the disclosures of which are incorporated herein by reference in their entireties.

FIELD OF INVENTION

The present specification refers to a patent application for packaging, which belongs to the field of containers, particularly for liquid products which are modified in order to provide practical and efficient use of the packaging, final preparation and use of dual liquid component products.

PRIOR ART DESCRIPTION

A dual component product is usually supplied to customers as a first and a second separate component, which should be mixed only when the product is ready to be used. Therefore, containers for dual liquid components must embrace means in order to attend this need, meaning, the container must be able to keep both components separated while stored and traded, the container must also have means to enable the mentioned first and second components to be mixed once the product is ready to be used, as well as some means to enable the use of the product according to its final formulation with both components already mixed.

Objectives of the Invention

Thus, the aim of the present arrangement is to provide a simple packaging for the dual liquid component product which achieves, in an efficient way, the following phases: product transportation and commercialization; component mixture; and usage of a dual liquid component product.

A further object of the present arrangement is to provide such a packaging that is simple and easy to be used by the final customer.

Yet, a further objective of the present arrangement is to provide a packaging which can be easily produced and assembled.

It is a further object of the present arrangement to provide a packaging with an affordable price.

BRIEF DESCRIPTION OF THE INVENTION

Taking into account considerations related to the prior art mentioned above and its associated objectives and the purpose to attend them, it was developed an arrangement for a dual liquid component product packaging, the object of the present patent application, which comprises: an upper and tubular part of the container fitted with a lower and inner thread; a sealed capsule which contains a first component, which composes the dual component product; a device for disruption and support which upholds the capsule that is placed inside the upper and tubular part of the container and which assists during the capsule's rupture; a lower and bigger part of the container which is designed to store a second component, which composes the dual component and also fitted with an upper and outer thread what is aimed to be screwed on the inner thread of the upper part of the tubular container; sealing rings; auxiliary device for usage of the dual component product, whose base lies on the neck of the upper and tubular part of the container and a dip tube that crosses the capsule and it is located inside and along the lower and bigger part of the container immersed in its content; these mentioned threads of the upper and lower parts of the container are originally only partially screwed and when the customer threads them up to the end, the capsule is, then, pushed against the cutting edges of the device designed for rupture and support, its seal is torn and the component stored in it mixes with the component located in the lower part of the container, forming then the dual component product with the final formulation.

This particular manner to build the packaging attends the invention objectives, with regards to the storage and trading phase of the product, since it is able to store properly and separately the first and the second components which compose the dual component product. Such packaging enables both components to be mixed by means of a simple rotation of one of its parts, producing the mixture with the final formulation just before its application begins. The auxiliary device for application eases the usage of the dual component product. All these specific features of the packaging meet the main goals of the present arrangement.

Moreover, the packaging has also an inexpensive and simple manufacture means, which attend all the other aims of the arrangement.

BRIEF DESCRIPTION OF THE DRAWINGS

The attached drawings refer to the arrangement for dual liquid packaging, which is the objective of this patent application, in which.

DETAILED DESCRIPTION OF THE INVENTION

According to the figures described above and contemplated by the arrangement, the packaging 1, object of the present patent application, is bound for being used for storage, final mixture and application of dual liquid component, formed by a first 100 and second 101 components, initially separate that must be mixed at the moment of its application in order to provide the final formulation of the dual component product 100-101, composed by the first 100 and the second 101 mixed components.

Figure 1:
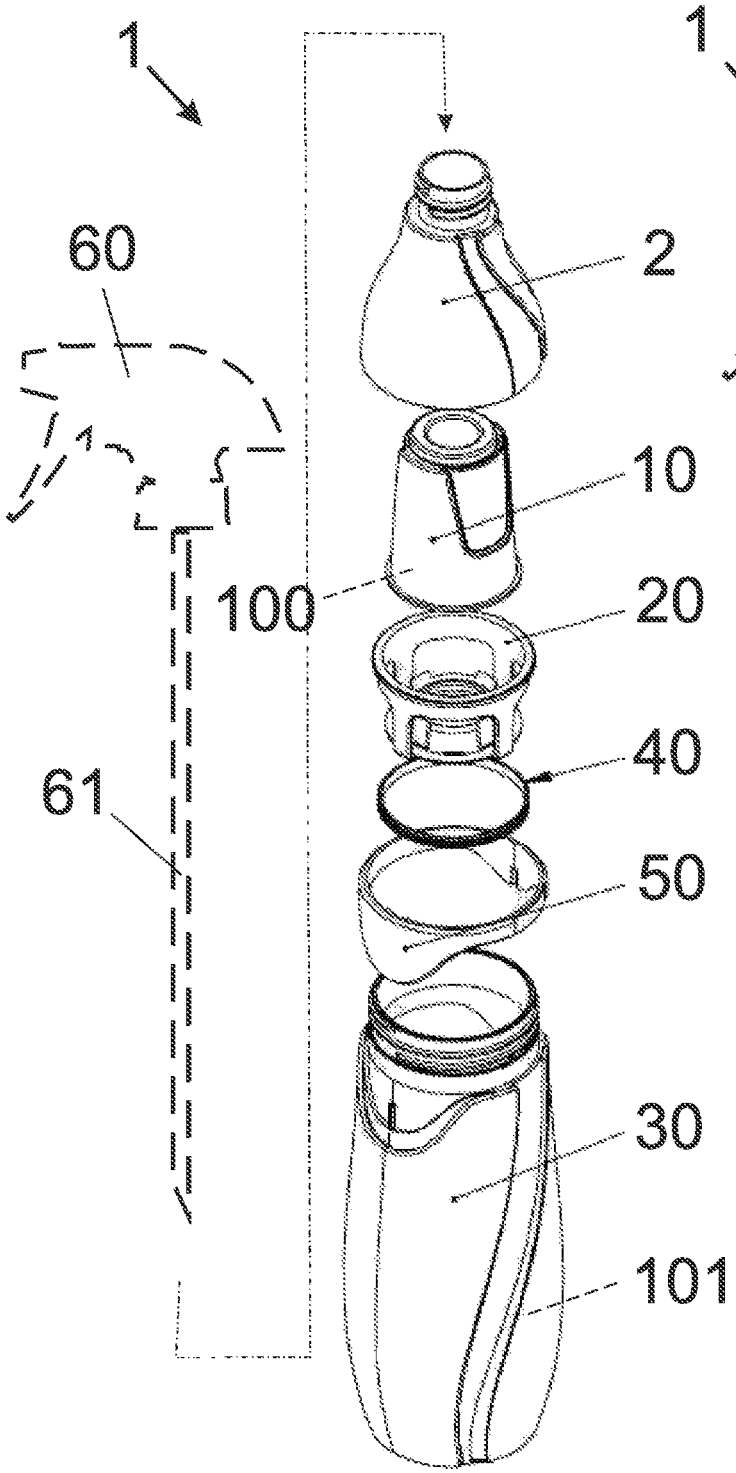
FIG. 1—shows the invention in an exploded view.
Figure 2:
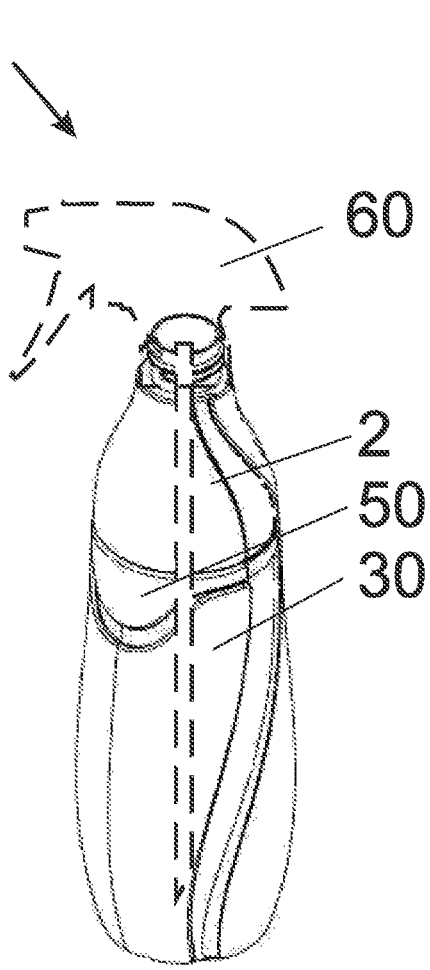
FIG. 2—shows the invention when it is assembled and in a perspective drawing.

In order to attend these requests, the packaging 1 is formed (FIGS. 1, 2): by an upper and tubular part of the container 2; by a sealed capsule 10 which contains a first component 101, that composes the dual component product 100-101; by sealing rings 40, 50; and by an auxiliary device for application of the dual component product 60, whose base is assembled on the neck 3 of the upper and tubular part of the container 2 and with the dip tube crossing the capsule 10 and located inside and along the lower and bigger part of the container 30 and immersed in the second component 101 housed by it.

Figure 3:
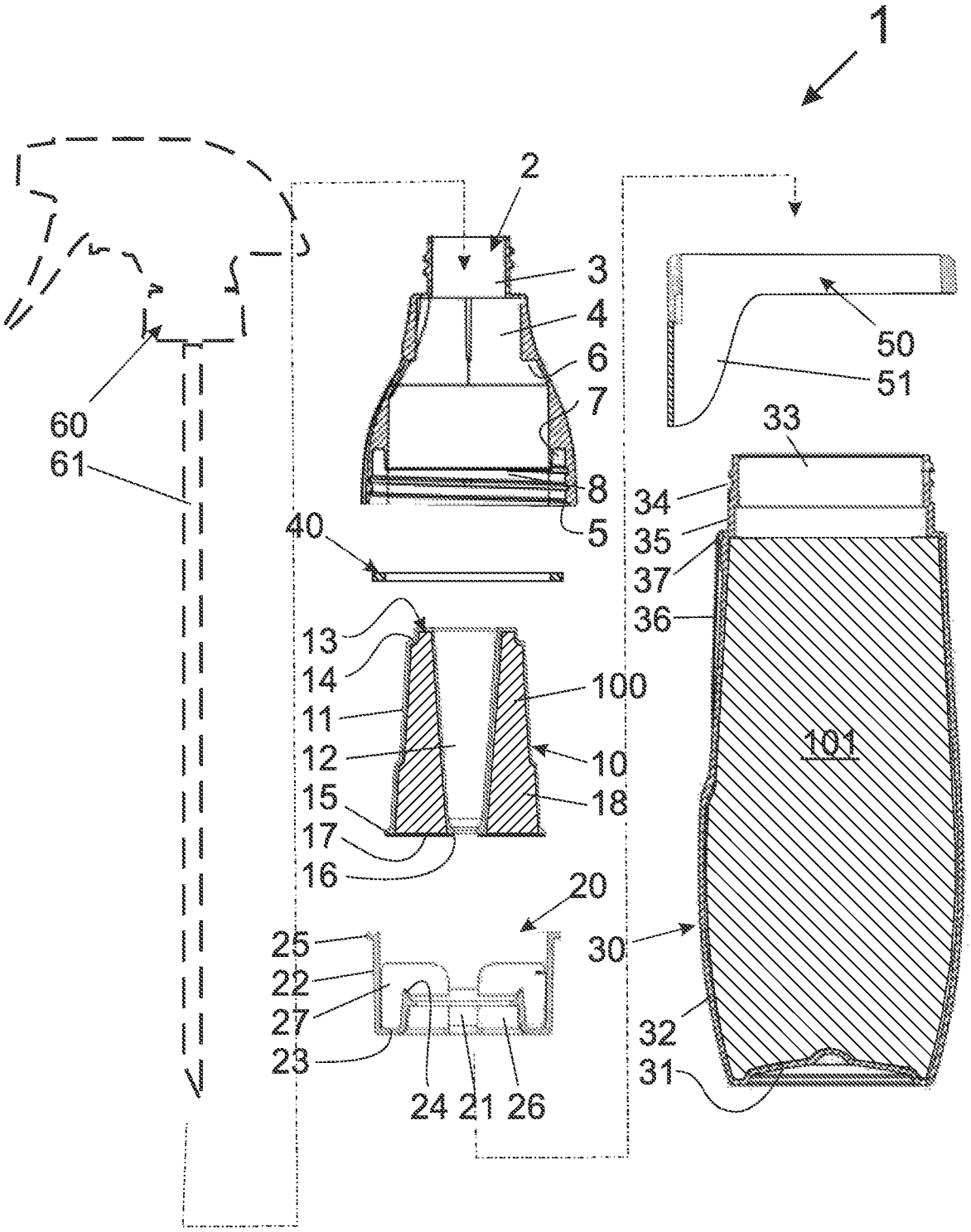
FIG. 3—shows a sectional drawing of the packaging and its parts taken apart.

In details, (FIG. 3, 4) the upper and tubular part of the container 2 is roughly frustum-shaped and comprises: an upper neck 3 fitted with an outer thread on which the auxiliary device 60 for application of the product is assembled; by a wall 4, that extends and widens from the neck 3 to the lower and open base that is wider and tubular 2 which comprises seats 7 that host the sealing ring 50 and the inner thread 8.

The lower and bigger part of the container 30 comprises: a bottom 31, a long wall 32 which extends from the bottom to the upper opening 33 fitted with an outer thread 34, a strip of seat 35 located under and parallel to the thread, this seat being surrounded by the sealing ring 50; such outer thread 34 and the inner thread 8 of the upper and tubular part of the container 2 are normally screwed on each other.

The sealed capsule 10 is defined by: a frustum-shaped part of the capsule with bigger diameter, such part is external 11 and conical with its wider opening on the bottom; another frustum-shaped part of the capsule with smaller diameter, such part is internal, tubular and concentric 12 with its wider opening on the top; and an annular and upper wall with a "Z" section 13, which has external and internal edges on what the external 11 and internal 12 parts of the frustum-shaped capsule are linked, respectively, and which also defines an external stop 14, which touches the internal stops 6 of the upper and tubular part of the container 2; such external part of the capsule 11 is fitted with an external frieze 15 around its lower base and the internal part of the capsule 12 is fitted with an internal frieze on its narrower and lower base 16, such capsule 10 comprises also a circular sealing ring 17, whose external and internal edges are attached to the friezes 15 and 16, respectively; such external 11 and internal 12 parts of the capsule, the upper and annular wall with a "Z" section 13 and the seal 17 form the annular chamber 18 what contains the first component 100 of the dual component product 100-101 and the part of the frustum-shaped capsule which is internal, tubular, narrower and concentric 12 compose an axial passage in the capsule 10, which is crossed by the dip tube 61 of the auxiliary device for application of the dual component product 60, such dip tube extends up to the bottom 31 of the lower part of the container 30.

The device for disruption and support 20 comprises: an annular and internal part which is narrower and shorter 21; an annular and internal part which is wider and longer 22 which is concentric to the internal and annular part 21; and an annular and lower wall 23 whose internal and external edges are attached to the mentioned annular internal 21 and external 22 parts, respectively; such annular part, internal, narrower and shorter 21 has cutting edges at its free upper end 24 in which the seal 17 of the capsule 10 lies; the free and upper end of the annular part, which is external, wider and longer 22 is fitted with an external frieze 25, which lies on the edge that defines the upper opening 33 of the lower and bigger part of the container 30; such internal 21 and external 22 annular parts what are fitted with wide openings 26, 27.

The sealing ring 50 surrounds the seat place 35 of the lower part of the container 30 what is roughly located in the middle height of packaging, has a wider area with a curved edge facing down 51 which is arranged on a lowered and external surface 36 of the lower part of the container 30, that has almost the same edge shape as the wider area 51 of the sealing ring 50, with the free edge of such wider area 51 and the step defined by the lowered surface 36 separated from one another by a distance.

The parts of the packaging 1 are made of injected plastic which is compatible with the packaged product, with the lower part 30 made of blown plastic, and the sealing rings made of rubber.

Figure 4:
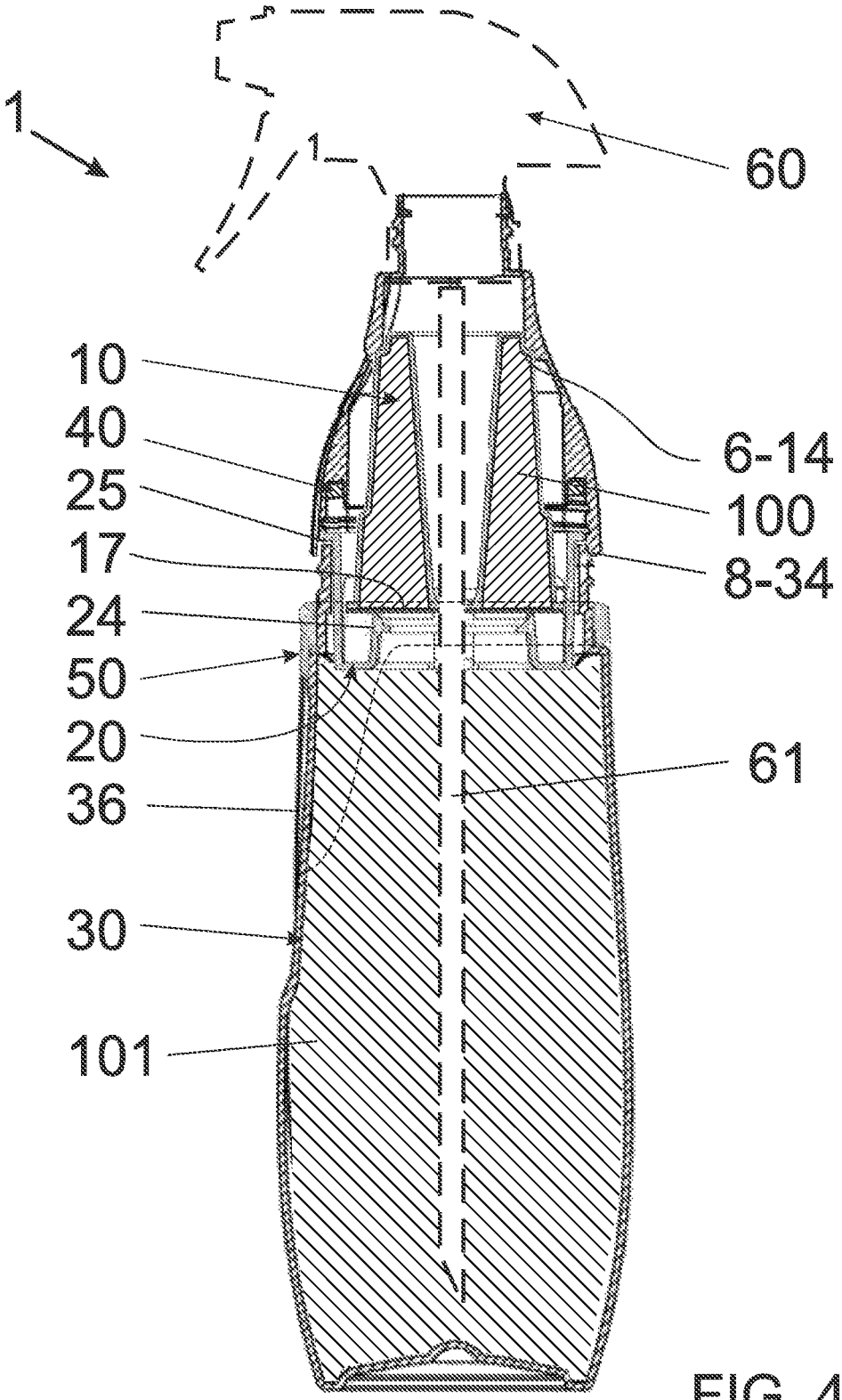
FIG. 4—shows a sectional drawing of the packaging and its parts already assembled as it can be seen during the storage and commercialization phase.

With regards to its operation, the packaging 1, originally, in order to meet the store and trading phase, before reaching the customer, shows the following layout according to FIG. 4, in which the threads 34 and 8 of the lower 30 and upper 2 part of the container are slightly screwed on each other. The capsule 10, which carries the component 100, has its lower seal 17 supported by the cutting edges 24 of the device for disruption and support 20 and with its upper stop 14 arranged against the upper and internal stops 6 of the upper part of the container 2. The auxiliary device for application of the dual component product 60 is assembled on the neck 3 of the upper part of the container 2 with its dip tube 61 crossing the inner part of the capsule 10, from the top to the bottom 31 and immersed in the second component 101, which is stored in the lower part of the container 30. The sealing ring 40 is adjacent and on the external frieze 25 what composes the device for disruption and support 20. The sealing ring 50 surrounds the seat 35 of such lower part of the container 30 and its wider area 51 inserted on its lowered area 36.

Figure 5:
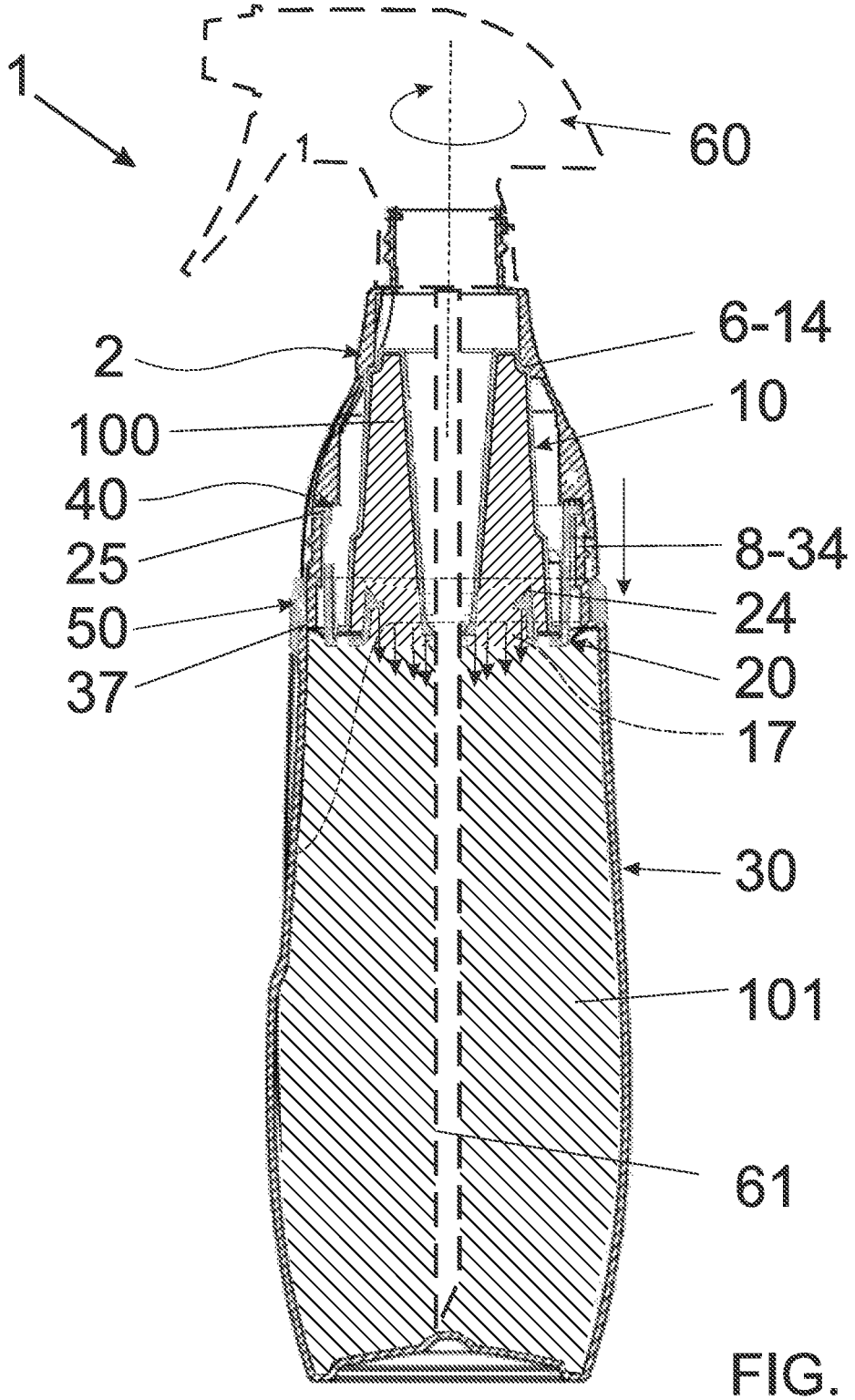
FIG. 5—shows a sectional drawing of the packaging and its parts already assembled with the indication of the capsule which contains one of the components of the dual component product being torn by means of its own packaging resources.

From that position, the customer turns the upper part of the container 2 (FIG. 5) in order to let its thread 8 to reach the end of the thread 34 located in the lower part of the container 30, by means of, and with the support of the upper stops 14 of the capsule 10 and the internal 6 stops of the upper part of the container 2, such capsule 10 is, then, pushed against the device for disruption and support 20, whose cutting edges 24 torn the seal 17 of such capsule 10, letting the component 100, which is stored in it, to mix with the other component 101, stored in the lower part of the container 30. By means of this action, the external frieze 25 of the device for disruption and support 20 reaches the sealing ring 40 providing internal sealing. The lower edge of the upper part of the container 2 moves forward and presses the external sealing ring 50 which is pressed against an external step 37 of the lower part of the container 30, enabling external sealing.

Figure 6:
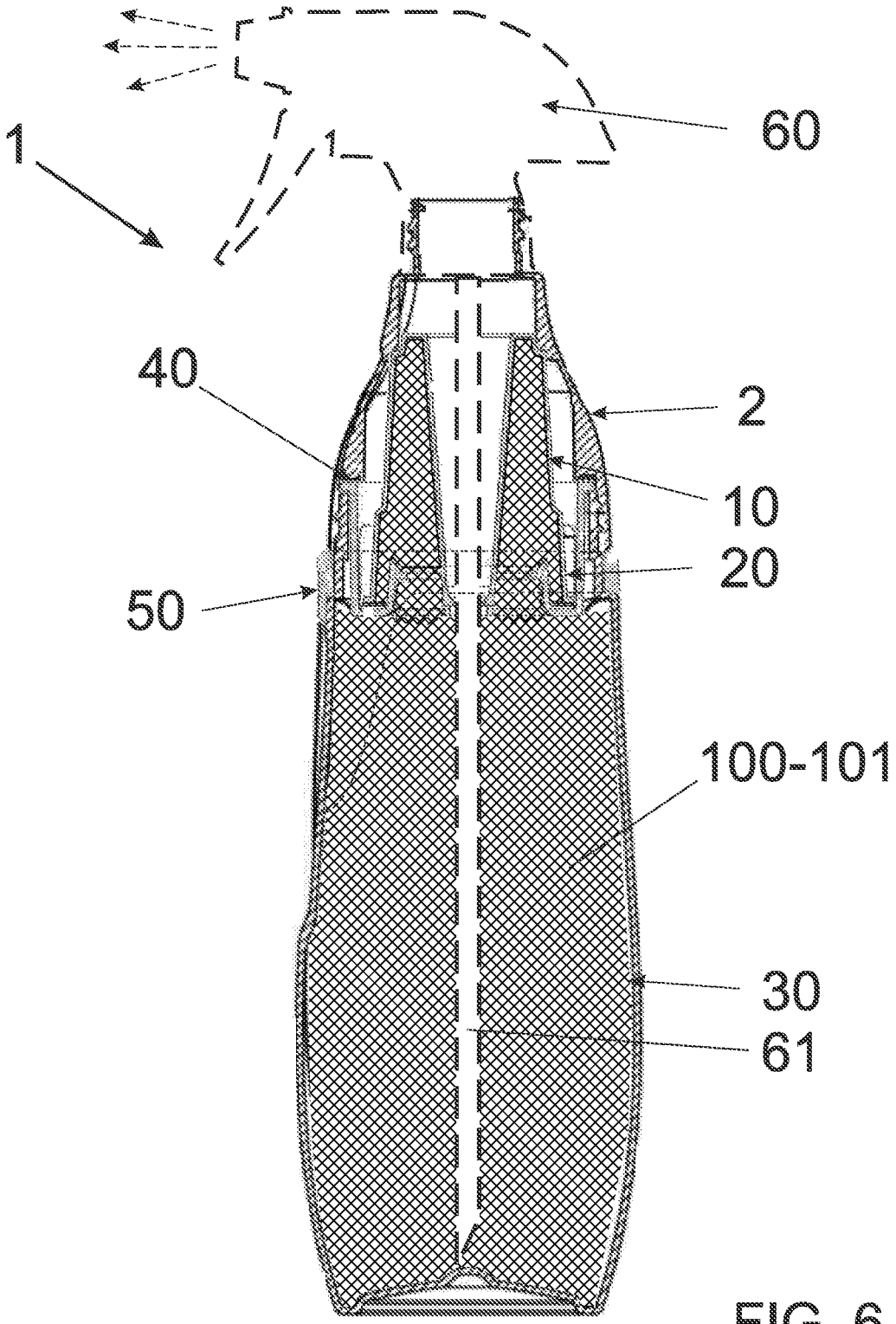
FIG. 6—shows the packaging ready for usage of the dual liquid product.

Once all these steps are already followed, the customer, by means of the auxiliary device for application of the dual component product 60, can use the dual component 100-101 product (FIG. 6). The auxiliary device for application of the dual component product 60, taken as example of construction for the description, is a spray. Nevertheless, other type of devices could be assembled, for example a dip tube with a top at its external end in order to compose a bottle to drink (squeeze) for a dual liquid component.

According to the basic construction described above, it is claimed the packaging 1, object of the present patent, might be modified with other materials, dimensions, functional and/or ornamental layouts, concerning to parameters or steps of the process without being excluded of the scope of the protection here requested.

The invention claimed is:

1. An arrangement for a packaging of a dual liquid component packaging, which comprises a first component and a second component, the arrangement for the packaging comprising:

a container;

an auxiliary device for application of the dual liquid component product, wherein the auxiliary device is assembled on the container, the container has an upper, tubular part having a frustum-shape, and a lower part that is bigger than the upper part, the upper, tubular part comprises:

an upper neck, in which the auxiliary device for application of the dual component product is assembled, and an upper wall with an open base, the open base being bigger than the upper neck, the upper wall being fitted with internal stops located internally near the neck and a seat located internally near the open base, the open base hosting a sealing ring with an internal thread, the lower part stores the second component and comprises: a bottom, a lower wall, an upper free end fitted with an external thread and an adjacent seat strip located under the external thread, the seat strip is surrounded by the sealing ring, and the external thread and an internal thread of the upper, tubular part are originally, partially screwed on each other;

a hermetically sealed capsule, which contains the first component, and which is defined by: a frustum-shaped portion at a top of the capsule and a conical-shaped portion having an opening on the bottom of the capsule, the external diameter of an opening in the frustum-shaped portion being bigger than the opening in the conical-shaped portion, wherein the frustum-shaped portion of the capsule has an internal diameter that is tubular and conical and that is smaller in diameter at the bottom than at the top, the capsule comprises an annular, upper wall with a Z shape on internal and external edges, the external and internal portions of the capsule are joined, respectively, the external and internal portions define an external stop that touches the internal stops of the upper, tubular part of the container, the external portion of the capsule is fitted with a lower, external frieze, the internal part of the capsule has an internal, lower frieze, the capsule is composed of a seal with a circle ring shape, the seal has internal and external edges that are joined to the external and internal friezes, respectively, the external and internal portions of the capsule, the annular, upper wall and the seal define an annular chamber which contains the first component, the frustum-shaped portion defines an axial passage inside the capsule that is crossed by a dip tube of the auxiliary device for application of the dual component product, the dip tube extends up to the bottom of the lower part of the container; and a device for disruption and support comprising: an internal annular part, an external annular part and a lower, annular wall, wherein the internal annular part is narrower and shorter than the external annular part, the lower, annular wall having internal and external edges that the internal and external annular parts are linked to, respectively, the internal annular part has an upper free end fitted with cutting edges on which the seal of the capsule is housed, an upper free end of the external annular part, which is wider and higher than a main portion of the external annular part is fitted with an external frieze, which is supported by an edge that defines the upper opening of the lower, bigger part of the container, the internal and external annular parts are fitted with wide openings, the sealing ring has a wide part with a curved edge facing down located on a lowered surface of an external area of the lower part of the container, the lower part of the container has an edge profile that is substantially the same as that of the wider area, and a free edge of the lower part of the container and a step defined by the lower part of the container are separate from one another.

2. An arrangement for a packaging of a dual liquid component, which comprises a first component and a second component, the arrangement for the packaging comprising:

a container;

an auxiliary device for application of the dual liquid component product and a capsule containing the first component, wherein the container has an upper, tubular part having a frustum-shape, and a lower part, the upper, tubular part comprises:

an upper neck, in which the auxiliary device for application of the dual component product is assembled, and an upper wall with an open base, the upper wall being fitted with internal stops located internally near the neck and a seat located internally near the open base, the open base hosting a sealing ring with an internal thread, the lower part stores the second component and comprises: a bottom, a lower wall, an upper free end fitted with an external thread and an adjacent seat strip located under the external thread, the seat strip is surrounded by the sealing ring, and the external thread and an internal thread of the upper, tubular part are originally, partially screwed on each other, and wherein the capsule is defined by a frustum-shaped portion at a top of the capsule and a conical-shaped portion having an opening on the bottom of the capsule.

3. The arrangement according to claim 2, wherein the external diameter of an opening in the frustum-shaped portion of the capsule is bigger than the opening in the conical-shaped portion of the capsule.

4. The arrangement according to claim 3, wherein, the frustum-shaped portion of the capsule has an internal diameter that is tubular and conical and that is smaller in diameter at the bottom than at the top.

5. The arrangement according to claim 2, wherein the capsule comprises an annular, upper wall with a Z shape on internal and external edges, the external and internal portions of the capsule are joined, respectively, and the external and internal portions define an external stop that touches the internal stops of the upper, tubular part of the container.

6. The arrangement according to claim 5, wherein the external portion of the capsule is fitted with a lower, external frieze, the internal part of the capsule has an internal, lower frieze, the capsule is composed of a seal with a circle ring shape, and the seal has internal and external edges that are joined to the external and internal friezes, respectively.

7. The arrangement according to claim 6, wherein the external and internal portions of the capsule, the annular, upper wall and the seal define an annular chamber which contains the first component.

8. The arrangement according to claim 2, wherein the frustum-shaped portion defines an axial passage inside the capsule that is crossed by a dip tube of the auxiliary device for application of the dual component product, and the dip tube extends up to the bottom of the lower part of the container.

9. The arrangement according to claim 7, wherein the frustum-shaped portion defines an axial passage inside the capsule that is crossed by a dip tube of the auxiliary device for application of the dual component product, and the dip tube extends up to the bottom of the lower part of the container.

10. An arrangement for a packaging of a dual liquid component, which comprises a first component and a second component, the arrangement for the packaging comprising:

a container;

an auxiliary device for application of the dual liquid component product and a device for disruption and support comprising: an internal annular part, an external annular part and a lower, annular wall, wherein the container has an upper, tubular part having a frustum-shape, and a lower part, the upper, tubular part comprises:

an upper neck, in which the auxiliary device for application of the dual component product is assembled, and an upper wall with an open base, the upper wall being fitted with internal stops located internally near the neck and a seat located internally near the open base, the open base hosting a sealing ring with an internal thread, the lower part stores the second component and comprises: a bottom, a lower wall, an upper free end fitted with an external thread and an adjacent seat strip located under the external thread, the seat strip is surrounded by the sealing ring, and the external thread and an internal thread of the upper, tubular part are originally, partially screwed on each other.

11. The arrangement according to claim 2, further comprising a device for disruption and support comprising: an internal annular part, an external annular part and a lower, annular wall.

12. The arrangement according to claim 10, wherein the internal annular part is narrower and shorter than the external annular part, the lower, annular wall has internal and external edges that the internal and external annular parts are linked to, respectively, and the internal annular part has an upper free end fitted with cutting edges on which the seal of the capsule is housed.

13. The arrangement according to claim 11, wherein the internal annular part is narrower and shorter than the external annular part, the lower, annular wall has internal and external edges that the internal and external annular parts are linked to, respectively, and the internal annular part has an upper free end fitted with cutting edges on which the seal of the capsule is housed.

14. The arrangement according to claim 10, wherein an upper free end of the external annular part, which is wider and higher than a main portion of the external annular part is fitted with an external frieze, which is supported by an edge that defines the upper opening of the lower, bigger part of the container, the internal and external annular parts are fitted with wide openings, the sealing ring has a wide part with a curved edge facing down located on a lowered surface of an external area of the lower part of the container, the lower part of the container has an edge profile that is substantially the same as that of the wider area, and a free edge of the lower part of the container and a step defined by the lower part of the container are separate from one another.

15. The arrangement according to claim 11, wherein an upper free end of the external annular part, which is wider and higher than a main portion of the external annular part is fitted with an external frieze, which is supported by an edge that defines the upper opening of the lower, bigger part of the container, the internal and external annular parts are fitted with wide openings, the sealing ring has a wide part with a curved edge facing down located on a lowered surface of an external area of the lower part of the container, the lower part of the container has an edge profile that is substantially the same as that of the wider area, and a free edge of the lower part of the container and a step defined by the lower part of the container are separate from one another.

* * * * *